US005496417A

United States Patent [19]

Farrugia et al.

[11] Patent Number: 5,496,417

[45] Date of Patent: Mar. 5, 1996

[54] PROCESS FOR STEAM CONVERSION COATING ALUMINUM

[75] Inventors: Marvin A. Farrugia, Prince Frederick, Md.; Hugh B. Burrell, Dahlgren, Va.

[73] Assignee: Electro-Steam Generator Co., Alexandria, Va.

[21] Appl. No.: 493,068

[22] Filed: Jun. 21, 1995

[51] Int. Cl.[6] ..... C23C 8/10

[52] U.S. Cl. ..... 148/275; 148/285

[58] Field of Search ..... 148/275, 285

[56] References Cited

U.S. PATENT DOCUMENTS

| | | | |
|---|---|---|---|
| 3,247,026 | 4/1966 | Switzer et al. . | |
| 3,964,936 | 6/1976 | Das . | |
| 4,149,912 | 4/1979 | Craighead et al. . | |
| 4,711,667 | 12/1987 | Bibber . | |
| 4,759,805 | 7/1988 | Saruwatari | 148/275 |

FOREIGN PATENT DOCUMENTS

| | | |
|---|---|---|
| 2727110A1 | 12/1978 | Germany . |
| 1368230 | 9/1974 | United Kingdom . |

OTHER PUBLICATIONS

Interim Report, Aug. 18, 1992, Non–Chromated Surface Pretreated For Aluminum, Report No. NADC–92077–60.

Phase Report, Jun. 24, 1992, Naval Air Warfare Center, Aircraft Division at Warminster Environmental Materials Program—Phase 1, Report No. NAWCADWAR–92075–60.

Military Specification, Jun. 30, 1970, Chemical Conversion Materials For Coating Aluminum and Aluminum Alloys, MIL–C–81706.

Military Specification, Nov. 30, 1990, Chemical Conversion Coatings on Aluminum and Aluminum Alloys, MIL–C–5541E.

Pharmaceutical Technology, Dec. 1982, Clean Steam in the Pharmaceutical Plant, Howard A. Forster and V., Kumar Gupta.

Stainless Steels for Bioprocessing, Part 3: Corrosion Phenomena, C. P. Dillon, D. W. Rahoi, and A. H. Tuthill.

BioPharm, Jun. 1990, "Rouge" and Its Removal from High–Purity Water Systems, Gopi R. Menon.

*Primary Examiner*—Sam Silverberg

*Attorney, Agent, or Firm*—Seidel Gonda Lavorgna & Monaco

[57] ABSTRACT

A conversion coating process for pretreating an aluminum or aluminum alloy surface in order to increase overlying coating adhesion and diminish corrosion and abrasion. The process involves delivering a flow of pure steam produced from deionized feedwater into a chamber. The flow of pure steam is directed against a baffle within the chamber causing the flow to diffuse. That is, the flow of steam is diverted from its initial direction of travel and caused to swirl. The surface of the aluminum or aluminum alloy metal is subjected to the swirling flow of pure steam so as to generate an oxide layer on the metal. The swirling pure steam subjects the resulting oxide layer to a pressure across its face which prevents the crystallization of the oxide layer in a defined and orderly pattern. The workpiece surface is preferably preheated to a threshold temperature prior to delivering the steam. In an alternate embodiment, the swirled flow of steam is circulated through the chamber and out of an exit port so as to maintain a non-static flow environment. The flow of steam exits the exit port and contacts the workpiece surface so as to generate the oxide layer. The process can be used as an intermediate step in a multi-step conversion coating process. The resulting aluminum-oxide film has superior work-environment performance and a high quality finish without any associated health or environmental risks. The process is designed to comply with U.S. military specification MIL-C-5541.

11 Claims, 8 Drawing Sheets

| BOILER PRESSURE (PSIG) | 0 | 1.0 | 1.5 | 2.0 | 2.5 | 3.0 | 3.5 | 4.0 | 4.5 | 5.0 | 5.5 | 6.0 |
|---|---|---|---|---|---|---|---|---|---|---|---|---|
| 60 | | × | | × | | × | | × | | × | | × |
| 55 | | | × | | × | | × | | × | | × | |
| 50 | | × | | × | | × | | × | | × | | SC |
| 45 | | | × | | × | | × | | × | | × | |
| 40 | | × | | × | | × | | × | | × | | SC |
| 35 | | | × | | × | | × | | × | | SC | |
| 30 | | × | | × | | × | | SC | | SC | | LC |
| 25 | | | × | | × | | SC | | LC | | C----→ | |
| 20 | | × | | × | | SC | | LC | | C----→ | | |
| 15 | | | LC | | LC | | C | | HC----→ | | | |
| 5 | | SC | | LC | | C | | HC | ----→ | | | |

TIME (MINUTES)

RESULTS: NOTE: THIS IS THE FIRST TEST SERIES USING PURE STEAM W/O HEADER AND AUTOCLAVE.

LEGEND: X - NO VISIBLE
SC - SLIGHT COATING (FILM STREAKS VISIBLE)
LC - LIGHT COATING (EVEN FILM FAINTLY VISIBLE)
C - EVEN COATING-ACCEPTABLE FOR FURTHER PROCESSING
HC - HEAVY COATING-DARK, EVEN FILM, ACCEPTABLE FOR PROCESSING

FIG. 7

RESULTS: NOTE: THIS TEST SERIES USES PURE STEAM GENERATOR W/HEADER, AND COMBINES RESULTS OF AUTOCLAVE, ATMOSPHERIC CHAMBER AND STEAM CANNON TESTS.

LEGEND: X-NO VISIBLE
SC-SLIGHT COATING (FILM STREAKS VISIBLE)
LC-LIGHT COATING (EVEN FILM FAINTLY VISIBLE)
C-EVEN COATING-ACCEPTABLE FOR FURTHER PROCESSING
HC-HEAVY COATING-DARK, EVEN FILM, ACCEPTABLE FOR PROCESSING

PROCESS FOR STEAM CONVERSION COATING ALUMINUM

FIELD OF THE INVENTION

This invention relates to a process for conversion coating aluminum and aluminum alloys with saturated pure steam in order to increase overlying coating adhesion and to diminish corrosion and abrasion.

BACKGROUND OF THE INVENTION

The chemical conversion coating of aluminum and aluminum alloys is known in the art. Typically, the process is used as a means to protect the metal from harsh service conditions.

The conversion coating is, generally, an intermediate film that exists between the metal surface and the overlying coating, such as paint. When applied uniformly and tightly bonded to an aluminum or aluminum alloy surface, the coating provides a protective layer that resists corrosion and abrasion as well as a substratum to which a final coating, if any, can firmly adhere.

Chemically established oxide films are superior to those that result from the natural oxidation of a surface. Natural oxide films form gradually as a result of the exposure of a metal surface to atmospheric heat and moisture. These films stratify and orient themselves in regular patterns and layers, and they are flaky, lack surface adhesion and thus are unsuitable as either a protective coating or a paint substratum.

Chemical conversion coating processes, by contrast, chemically etch the surface of a metal under controlled conditions to form an oxide film on the surface of the metal, which can then be further processed. A widely accepted chemical conversion coating process for aluminum and aluminum alloys is to treat the surface of the metal with a chromic acid or chromicphosphate solution to chemically form a chromate film. Generally, these chromate films can be efficiently formed and produce superior performance ratings compared to alternative compositions. The films are aligned in random patterns and layers, cohesive in nature and, where sealed, act as an ideal corrosion and abrasion barrier and coating substratum.

Notwithstanding its success in the industry, chromate processes are not without serious disadvantages. First, chromium chromate is a carcinogen, a fact that renders workplace safety difficult to maintain. Second, its high toxicity creates a waste disposal problem, which has resulted in ecological harm in some cases. These problems, indeed, have led to greater governmental control of the use of chromate coatings material, effective in 1995.

Conversion coating processes other than those that use chromium chromate-based solutions to pretreat aluminum and aluminum alloys have been disclosed. For example, formation of protective layers by use of boiling aleionized water and an aqueous alkali metal permanganate composition and a proprietary lithium nitrate bath is known in the art. However, no conversion coating process has achieved the high degree of industry acceptance and superior performance ratings of chromate-oxide fills.

The merits of steam as a post-treatment sealing agent for anodized aluminum and aluminum alloys have long been recognized. In this stage of treating the metal, steam is used not to create a conversion coating, but rather to increase the resistance of an anodic coating to staining and corrosion.

The steam, moreover, serves to improve the durability of the color produced in the anodic coating and may impart other desirable properties.

It has been suggested that low density steam at high surface temperatures (around 300° F.) and high pressure could be used to form a high quality aluminum-oxide conversion coating without the negative effects associated with chromate films. Comprehensive study of the process under these narrowly prescribed conditions, however, failed to validate the theory. Indeed, not a trace of the aluminum-oxide film was detected in this or a similar environment. Moreover, any oxide coating that does form on an aluminum workpiece surface will take a considerable amount of time to develop.

Several prior art processes have incorporated additives into the steam, such as accelerating agents or chemical reagents. Examples of these are $HNO_3$, $H_2O_2$, and carboxylic acid. These additives are designed to assist in the development of the oxide layer on the aluminum by speeding up the oxide layer growth. However, as with chromate coatings, the additives may be potentially harmful to the environment. Furthermore, the additives increase the overall cost of the manufacturing process since they must be added to the steam or coated onto the aluminum before subjecting the workpiece to the steam.

In these prior art processes, the purity of steam was not considered to be important. On the contrary, the incorporation of additives, such as accelerating agents, destroys any steam purity that may have originally existed. The inventors of the present invention have determined that the incorporation of these accelerating agents, while increasing the speed of oxide layer development, have the detrimental effect of depositing a residue on the surface of the workpiece. The residue can, in certain instances, degrade the adhesive capability of the oxide layer. For example, when steam is created from standard tap water and applied to an aluminum workpiece, calcium carbonate and/or sodium chloride deposits can result. These deposits severely reduce the adhesive capabilities of the oxide coating. It has also been determined that acceleration agents tend to draw corrosive agents through the coating to the base metal.

Thus, a need for a viable substitute process that eliminates toxic metal solutions still exists. There is also a need for a steam conversion coating process that rapidly produces an acceptable primary oxide film within a low surface temperature range. There is a further need to achieve these goals through a process design that is both economical and without the negative side effects associated with chromate films.

The present invention is a conversion coating process that satisfies these needs.

SUMMARY OF THE INVENTION

In one embodiment, the invention comprises a conversion coating process for pretreating an aluminum or aluminum alloy surface. The method comprises the steps of delivering a flow of pure steam produced from aleionized feedwater into a chamber. The flow of pure steam is directed against a baffle within the chamber causing the flow to diffuse. That is, the flow of steam is diverted from its initial direction of travel and caused to swirl. The surface of the aluminum or aluminum alloy metal is subjected to the swirling flow of pure steam so as to generate an oxide layer on the metal. The swirling pure steam subjects the resulting oxide layer to a pressure across its face which prevents the crystallization of the oxide layer in a defined and orderly pattern.

In one alternative embodiment, the process further comprises the steps of first preheating the workpiece surface to a threshold temperature prior to delivering the steam. Next, a feedwater supply is deionized and boiled to form the pure steam.

In another alternate embodiment, the swirled flow of steam is circulated through the chamber and out of an exit port so as to maintain a nonstatic flow environment. The flow of steam exits the exit port and contacts the workpiece surface so as to generate the oxide layer.

These and other features, aspects and advantages of the present invention will become better understood with reference to the following description and the appended claims.

BRIEF DESCRIPTION OF THE DRAWINGS

For the purpose of illustrating the invention, the drawings show a form of the invention which is presently preferred. However, it should be understood that this invention is not limited to the precise arrangements and instrumentalities shown in the drawings.

FIG. 7 illustrates a first set of test results which involved subjecting aluminum panels to pure deionized steam.

DESCRIPTION OF THE INVENTION

Figure 1:
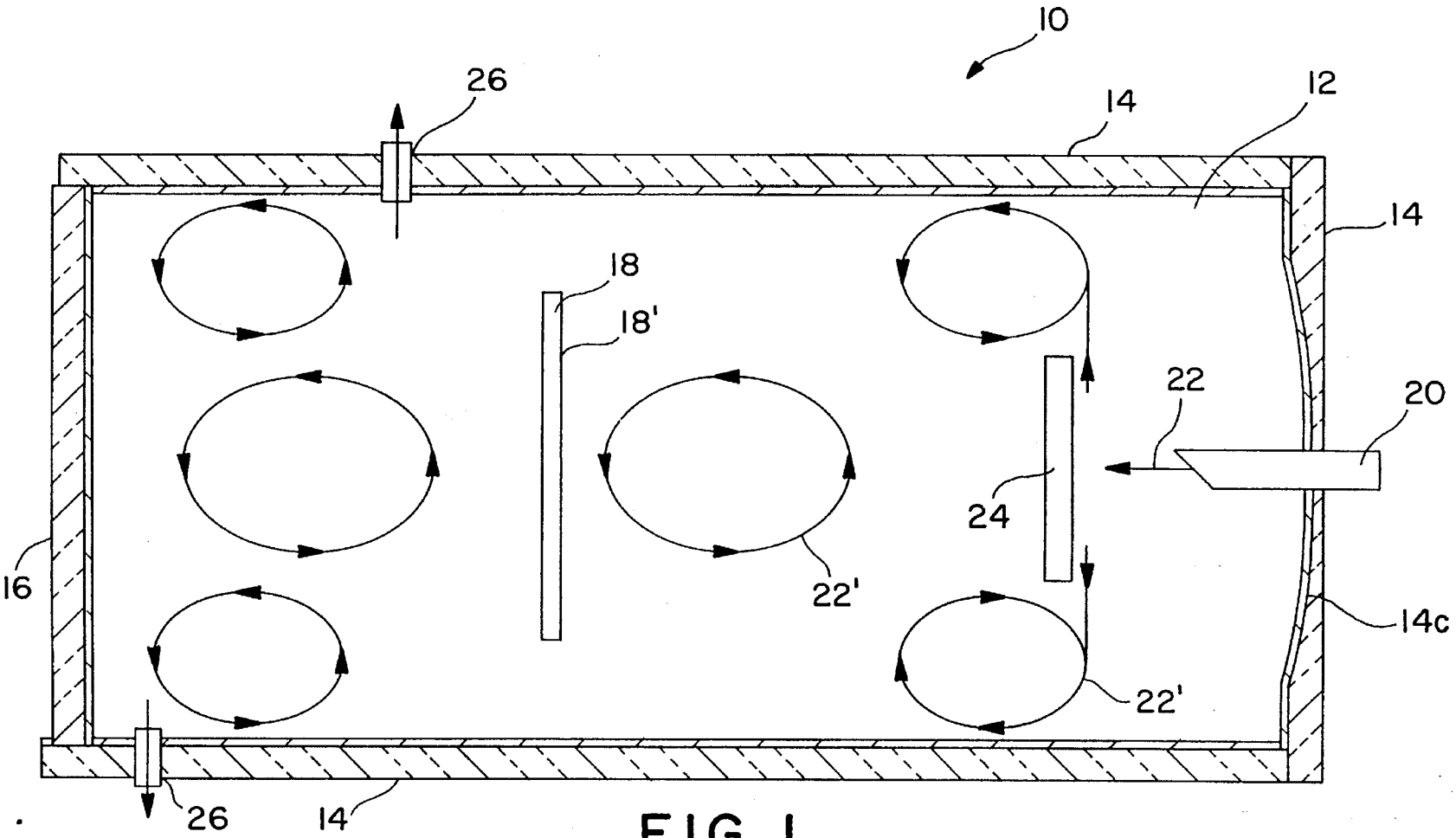
FIG. 1 is a plan view of the present invention illustrating the flow patterns of the pure steam with respect to the work piece.

Referring now to the drawings, wherein like reference numerals indicate corresponding or similar elements throughout the several views, FIG. 1 illustrates the novel conversion coating process of the present invention for pretreating the surface of aluminum or aluminum alloy. In general terms, the process involves subjecting the surface of the aluminum workpiece to a pressure flow of saturated pure steam. As will be discussed in more detail below, the purity of the steam in combination with the flow pattern of the steam and the preheating of the workpiece enhances the development of an oxide or conversion coating on the aluminum surface. For brevity, the workpiece is referred to as being aluminum. However, it should be noted that the invention is equally applicable to workpieces made from aluminum alloys. The conversion coating which is generated by the process of the invention provides a cohesive layer upon which further finishing coatings can be applied.

As discussed above, the current processes for creating a conversion coating do not utilize pure steam. Instead, these processes introduce chemical reagents into the steam, which leave residues on the surface of the workpiece that degrade the adhesion of the oxide layer. It has been determined that the utilization of pure steam significantly increases the development of an oxide layer on an aluminum workpiece. The pure steam also provides improved oxide layer adhesion.

The purity of the steam in the present invention is achieved by utilizing deionized feedwater which has been subjected to a purification process prior to conversion into steam. The purification process removes substantially all the organic compositions and minerals which naturally exist in water. Steam from water which has had organic matter removed is known as "clean" steam. However, the present invention goes one step further and removes the ions which are also present in water. The aleionization process, in combination with the removal of the organic matter, results water totally free of organic compounds and which can be used to create ultra-pure steam. The deionization and purification of the water can be achieved through a variety of different procedures. However, it is preferred that the water be deionized and then boiled in a pure steam boiler or induction heater to produce the final pure steam. The resulting steam preferably contains less than about 1 part per million of silica and total organic carbon and has a resistance of about 18 megohms. Normal non-pure water typically has a resistance of about 2 milli-ohms. The resistivity of the water increases as its purity increases. The use of deionized and purified steam has typically been limited to the pharmaceutical industry for sterilizing surfaces. (See, Forster, Howard A. and Gupta, V. Kumar, "Clean steam in the pharmaceutical plant", *Pharmaceutical Technology*, December 1982, pp.54-, et seq.)

The purity of the steam also facilitates the development of the oxide layer on the aluminum workpiece. It has been determined that, when aluminum is exposed to pure steam containing virtually no organic and ionic matter, the "aggressiveness" of the aluminum increases substantially. That is, the non-ferromagnetic properties of aluminum result in increased oxide formation on the aluminum surface. The increased aggressiveness of the workpiece reduces the time required to form a sufficiently thick oxide layer.

Referring to FIG. 1, an apparatus for creating a conversion coating on an aluminum workpiece according to the present invention is illustrated and generally designated by the numeral 10. The apparatus includes a chamber 12 which includes thermally insulative walls 14 and an access door 16. An aluminum workpiece 18 is positioned within the chamber 12 on a rack (not shown). A nozzle 20 is mounted in one of the walls 14 and arranged so as to direct an input flow 22 of pure steam into the chamber 12. A baffle or diffuser 24 preferably is positioned between the workpiece 18 and the nozzle 20 so as to interfere with or redirect the axial direction of travel of the input flow 22. Exit ports 26 are provided in the walls 14 at locations on the opposite side of the workpiece 18 from the nozzle 20.

As shown in FIG. 1, the baffle 24 deflects the input flow 22 at an angle to its axial direction of travel. There are several reasons for diverting the flow of steam. Direct impact of the steam flow on the workpiece surface 18' tends to inhibit the development of an oxide layer because, during formation, the oxide layer is in a relatively fragile gelatinous state. Accordingly, direct steam impact causes the layers to scour or strip completely off the workpiece surface 18'. By diffusing the flow of steam though the use of the baffle 2,4, the scouring of the oxide layer is prevented, thus permitting it to grow to a desired thickness.

The baffle also serves to assist in the removal of contaminants and water droplets entrained in the steam. As discussed above, it is preferable that pure steam be utilized in the present process. However, it is not always possible to remove all the organic matter in the water prior to conversion into steam. Similarly, the formation of steam from feedwater does not completely remove all water droplets. By placing the baffle 24 in front of the flow, any entrained contaminates and water droplets are forced to strike the baffle 24. This dislodges the contaminants and water droplets from the steam flow.

The baffle 24 additionally creates a diverted flow 22' which travels around the baffle 24 in a swirling or cyclonic manner. As will be discussed below, this swirling steam flow pattern assists in the development of the oxide layer. The swirling of the steam flow also assists in further purifying the steam by centrifugally dispersing any remaining entrained contaminants or water droplets. In order to facilitate the swirling of the flow, the walls 14 of the chamber 12 are preferably configured with a slight curvature. For example, as shown in FIG. 1, the wall 14 facing the baffle 24 can be formed with a concave portion 14*c*. Accordingly, when the flow of steam is deflected by the baffle 24, the curvature of the wall assists in creating the desired swirling of the steam flow.

The swirling flows 22' circulate through the chamber 12. The swirling flows 22' strike the surface 18' of the workpiece 18 in a direction approximately parallel to the plane of the surface 18'. That is, the steam flows substantially across rather than against the surface 18' of the workpiece. The flow of the steam across the workpiece surface 18' produces a unique oxide layer formation which enhances the development of the oxide layer. As discussed above, it is known that exposure of aluminum to static steam will result in the growth of an oxide layer. However, it has been determined that the resulting oxide layer has poor adhesive properties because the layer crystallizes in a defined and orderly pattern which is relatively brittle and easy to fracture.

The process according to the present invention subjects the developing oxide layer to a flow across the workpiece surface 18' while the oxide layer is in its gelatinous state. At process temperature described below, the oxide film has a gelatinous consistency and very little surface adhesion, but it becomes tightly adherent and amorphous as the surface temperature falls. (When the film is in a gelatinous state, the use of a slight positive pressure across the work surface facilitates oxide development without scouring away the film). The flow across the work surface prevents the oxide layer from developing and crystallizing in a defined and orderly pattern. Instead, the resulting oxide layer crystallizes in a random or amorphous pattern. This amorphous pattern substantially increases the adhesive properties of the layer, thus creating a stronger conversion coating to which the final coating can be applied. The swirling of the pure steam achieves this flow across the surface 18'. The swirling effectively achieves a "stall" condition on the surface 18' of the workpiece. That is, the flow does not attach the surface in a laminar fashion but, instead, flows across and away from the surface.

It is important to maintain the flow of steam across the workpiece surface 18'. Hence, the flow of steam within the chamber 12 must not become static or stagnant. The exit ports 26 are designed to permit the steam to exit out of the chamber 12 and, thus, prevent the stem flow within the chamber from becoming static. However, while the utilization of exit ports 26 is preferred, they are not necessarily required since the process according to the present invention only requires a short amount of time to generate a sufficient oxide layer. Depending on the chamber configuration, a sufficiently thick oxide layer may develop before the steam becomes static or stagnant.

The steps of the novel conversion coating process will now be discussed with reference to the apparatus disclosed above. An aluminum workpiece is positioned within the chamber 12 on the opposite side of the baffle 24 from the nozzle 20. The chamber 12 is then preferably heated up to a predetermined or threshold temperature before the steam is introduced into the chamber 12. It has been determined that heating of the workpiece to an elevated temperature, preferably above the boiling point of water, facilitates the growth of an oxide layer. However, overheating of the workpiece produces a oxide coating having poor adhesive qualities. The preferred temperature range is between about 215° F. and about 250° F. More preferably, the chamber 12 and the surface 18' of the workpiece are heated to between about 230° F. and 250° F. The desired threshold temperature will vary depending on at least the temperature, pressure and velocity of the steam, and the type of workpiece (material composition, shape, etc.) being processed. The time required to get the workpiece to the threshold temperature will vary depending on the size, shape and material composition of the workpiece.

The means by which the surface of the workpiece is raised to and maintained at the desired temperature may be of any type commonly employed to heat a workpiece, such as a radiant heater. Alternately, it may be preferable to heat the aluminum or aluminum alloy workpiece by simple exposure to the pure steam itself. That is, in this embodiment, the pure steam serves a preheating function in addition to producing the aluminum-oxide conversion film.

After heating the workpiece surface 18' to the desired temperature, the pure steam is then introduced into the chamber 12 through the nozzle 20. As discussed above, the steam is preferably pure steam which is substantially totally free of organic compounds, since the use of pure steam facilitates the development of an oxide layer with strong adhesive qualities. Preferably there are less than 1 ppm of silica and total organic carbon. The chamber 12 is preferably unpressurized or is at a relatively low pressure when the steam is delivered. The steam, on the other hand, is preferably delivered in a pressurized state. Accordingly, as the pressurized saturated steam enters the chamber 12 it expands.

Figure 2A:
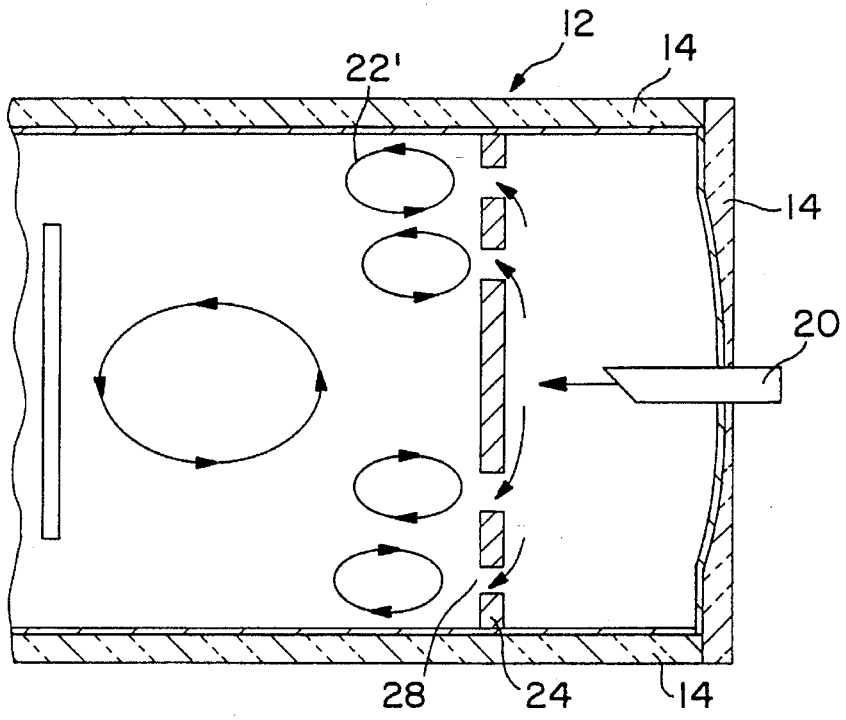
FIGS. 2A and 2B illustrate alternate baffle configurations for the present invention.
Figure 2B:
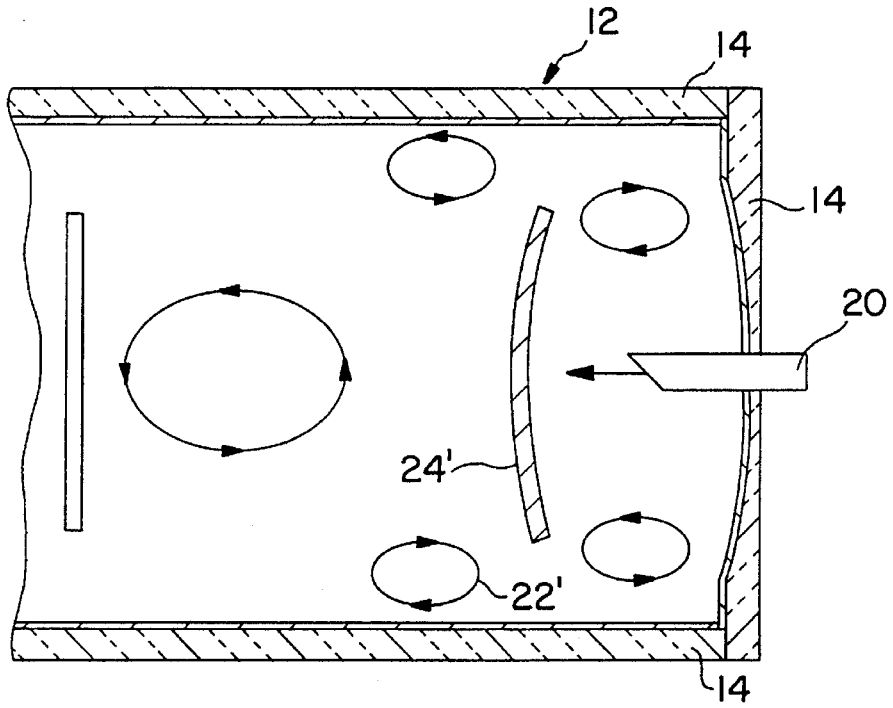

The flow of steam is directed toward the baffle 24. The baffle redirects or diffuses the flow of steam, creating cyclonic swirling flows 22'. These swirling flows 22' travel through the chamber and strike the surface 18' of the workpiece. The baffle 24 in FIG. 1 may be a flat rectangular piece of steel. It is also contemplated that alternate shapes may be utilized. Referring to FIGS. 2A and 2B, the baffle may be configured to extend completely between the side walls 14 of the chamber 12. A series of apertures 28 are formed through the baffle 24. The apertures 28 permit the steam to flow through the baffle 24 in a diffused pattern. As shown in FIG. 2B, the baffle 24 may be formed with a curvature which increases the swirling of the diverted steam flow. Those skilled in the art would readily be capable of incorporating various other mechanisms for creating and enhancing the swirling of the steam flow without departing from the scope of the invention.

Through experimentation, the inventors have determined that the pressure and velocity at which the steam is delivered into the chamber 12 is an important factor in the generation of the oxide layer. The velocity at which the steam expands and contacts the surface of the aluminum or aluminum alloy workpiece should be relatively low. It is preferable that the velocity not be so high as to strip off the developing oxide layer. However, the delivery velocity should not be so low as to prevent a flow of swirling steam across the workpiece surface 18'. It has been determined that a preferred velocity delivery rate for achieving the desired flow in the aforementioned apparatus is between about 0.3 and 1.3 CFM. This range of delivery velocities prevents the flow of steam within the chamber from becoming static or stagnant during oxide layer formation. The required velocity will, of course, vary depending on the configuration of the apparatus. For example, if the baffle 24 and the workpiece are spaced a significant distance from the nozzle 20 or if the chamber is excessively large, then the delivery velocity may have to be higher. Preferably, the steam should be fully expanded, free of entrained moisture droplets, and travelling at a velocity of not greater than 5 ft./min., to prevent spotting and coating unevenness. The most preferred range of velocity across the surface of the workpiece is between about 1 ft./min. and 3 ft./min. This velocity range has been determined to be fast enough to prevent the water droplets from forming on the surface, yet slow enough to prevent the uneven formation of the oxide layer on the surface.

The pressure at which the steam is discharged or delivered into the chamber 12 is also a factor in the growth of the oxide layer. If the pressure is too low, the crystal growth will not be disrupted while the oxide layer is in its gelatinous state. Similarly, if the delivery pressure is too excessive, the flow across the workpiece surface will scour or strip the developing oxide layer off. It has been determined that a delivery pressure at the nozzle 20 between about 1 psig and about 80 psig would be sufficient to produce the desired oxide layer. More preferably, the delivery pressure at the nozzle 20 is between about 30 psi and about 80 psi. These delivery pressures will produce a desired pressure acting across the workpiece surface of between about 1 psi and about 5 psi. More preferably, the pressure acting across the workpiece surface 18' is between about 2 psi and about 4 psi.

As stated above, the chamber 12 is preferably unpressurized or is at a relatively low pressure when the steam is delivered. Accordingly, as the pressurized saturated steam enters the chamber 12 it expands. The expansion of the steam causes it to condensate on the surface 18' of the heated workpiece.

Testing has been conducted on various aluminum workpieces. It has been determined that, after subjecting the workpiece the flow across its surface 18' for about 2 to 3 minutes, a primary aluminum-oxide conversion coating develops on the workpiece which is sufficiently thick and cohesive to permit an overlying coating to be applied. The weight and thickness of the oxide layer will vary proportionately to the amount of time that the workpiece is exposed to the steam.

After the oxide layer has been formed to the desired thickness, the workpiece is cooled to stabilize the amorphous crystal formation. After cooling, post-conversion coating procedures, such as painting, may be undertaken.

Figure 3:
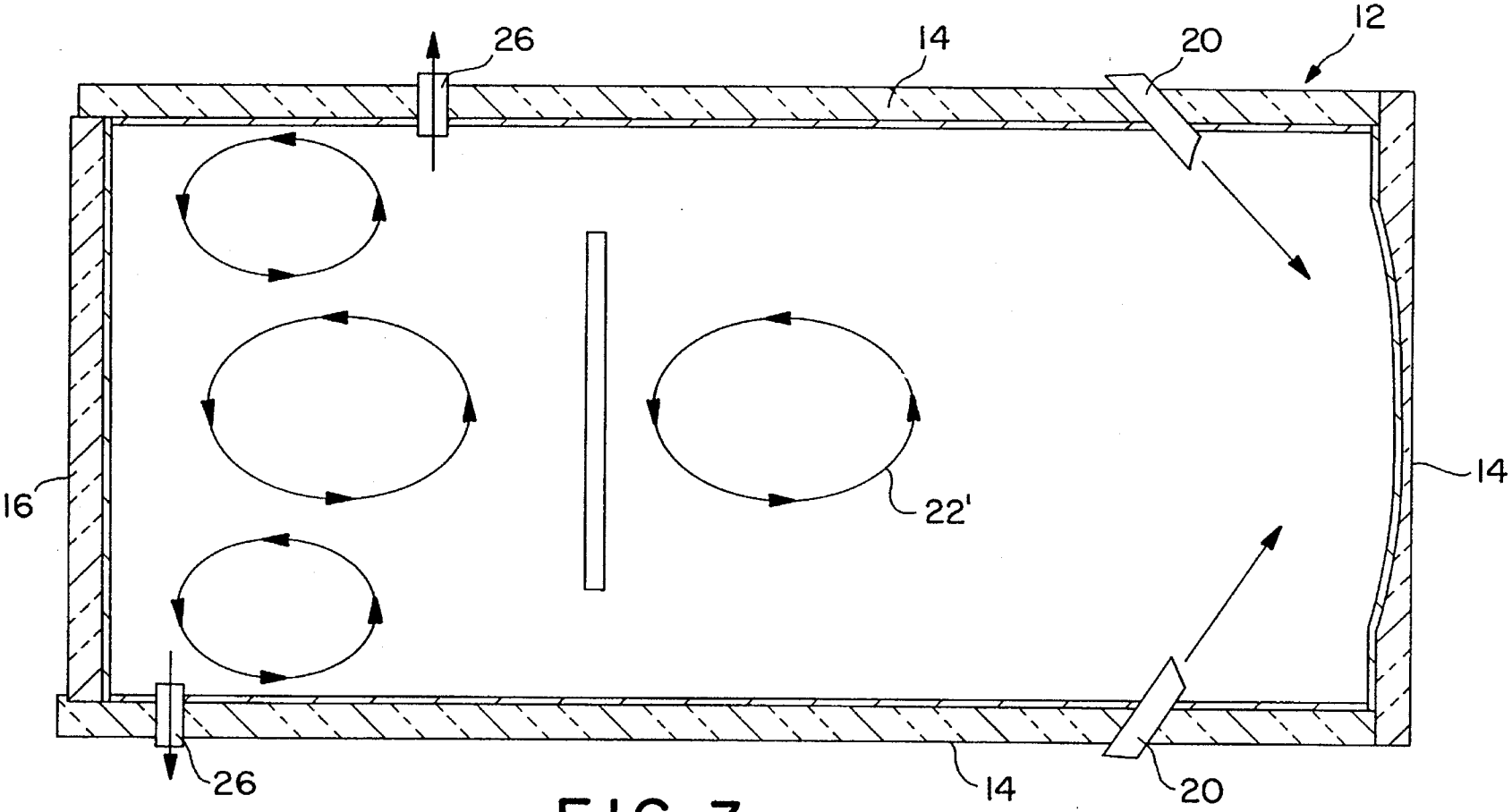
FIG. 3 illustrates an alternate nozzle mounting arrangement.

In the embodiment illustrated in FIG. 1, the nozzle 20 is mounted at a right angle to the baffle 24. Alternate nozzle mounting arrangements are contemplated within the purview of the invention. For example, referring to FIG. 3, it may be desirable to eliminate the baffle 24. Instead, the nozzle 20 directs the flow of steam toward one of the walls 14. The steam strikes the wall 14 and diffuses to form swirling flows. Those skilled in the art would readily appreciate the diverse nozzle mounting arrangements which may be practiced within the scope of this invention.

Figure 4:
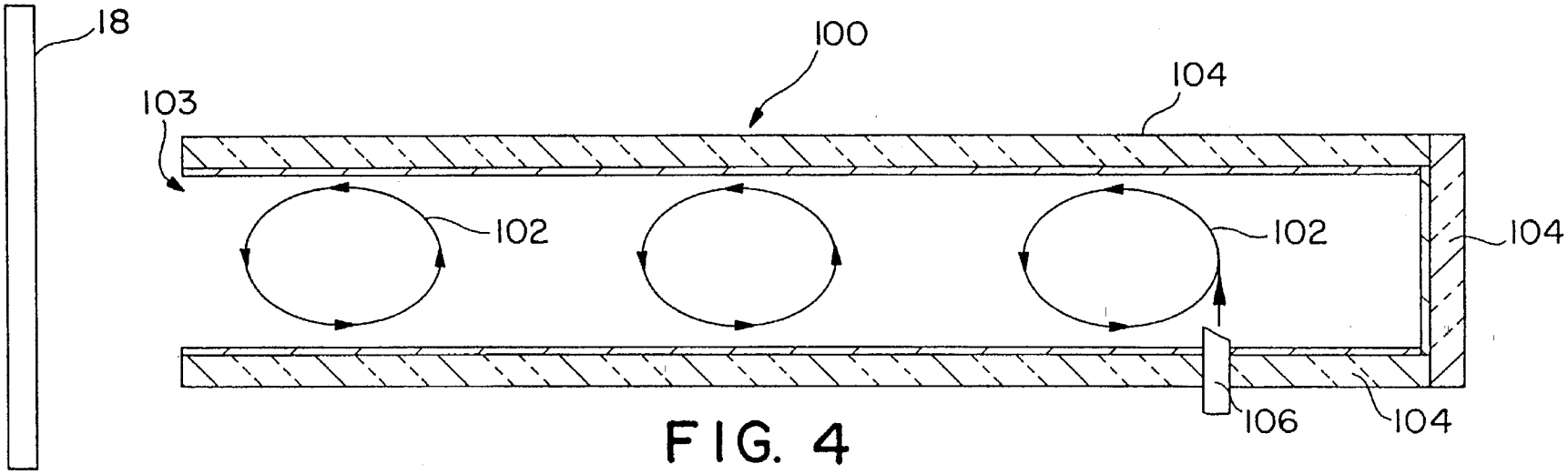
FIG. 4 illustrates an alternate embodiment of the invention wherein the workpiece is positioned outside the steam delivery chamber.

In the above embodiments, the steam was applied to the workpiece 18 within a chamber 12. However, sometimes the size and location of workpieces prevent the use of a steam chamber (e.g., aircraft fuselage skins). Referring now to FIG. 4, an alternate embodiment of the invention is illustrated wherein the workpiece 18 is too large to fit into a steam chamber. In this embodiment, a steam delivery chamber 100 delivers a swirling flow 102 of steam to the workpiece 18, which is positioned outside an exit port 103. The steam delivery chamber 100 includes walls 104 and a nozzle 106. The nozzle 106 is mounted so as to cause the flow of steam to swirl. In the illustrated embodiment, the nozzle 106 directs the flow of steam against one of the walls 104. Alternately, the nozzle 106 could direct the flow of steam against a baffle (not shown). In yet another embodiment, the flow of steam may be delivered into the steam delivery device in a circular or cyclonic manner.

Figure 5:
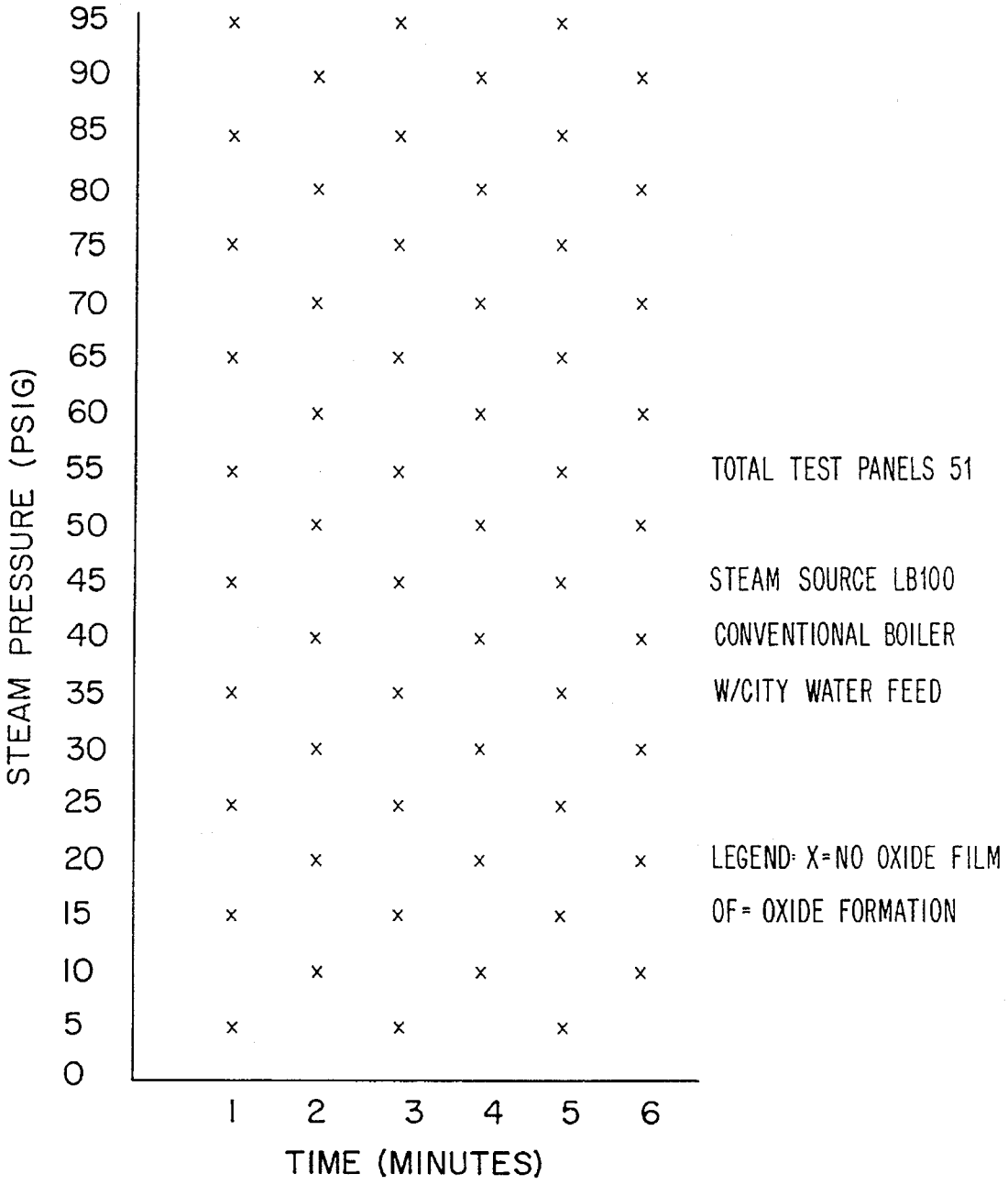
FIG. 5 illustrates a first set of test results which involved subjecting aluminum panels to impure steam.
Figure 6:
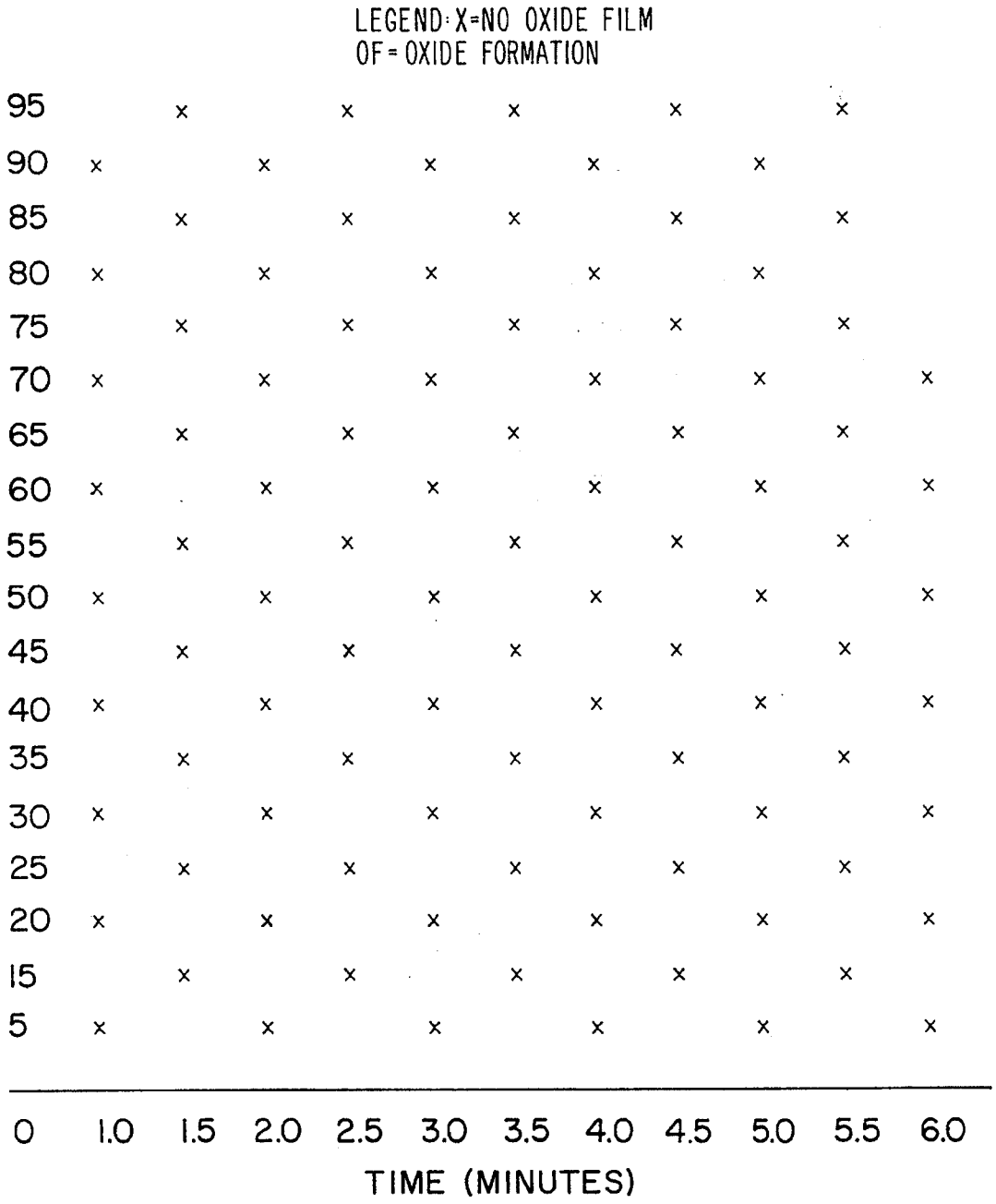
FIG. 6 illustrates a second set of test results which involved subjecting aluminum panels to impure steam.
Figure 8:
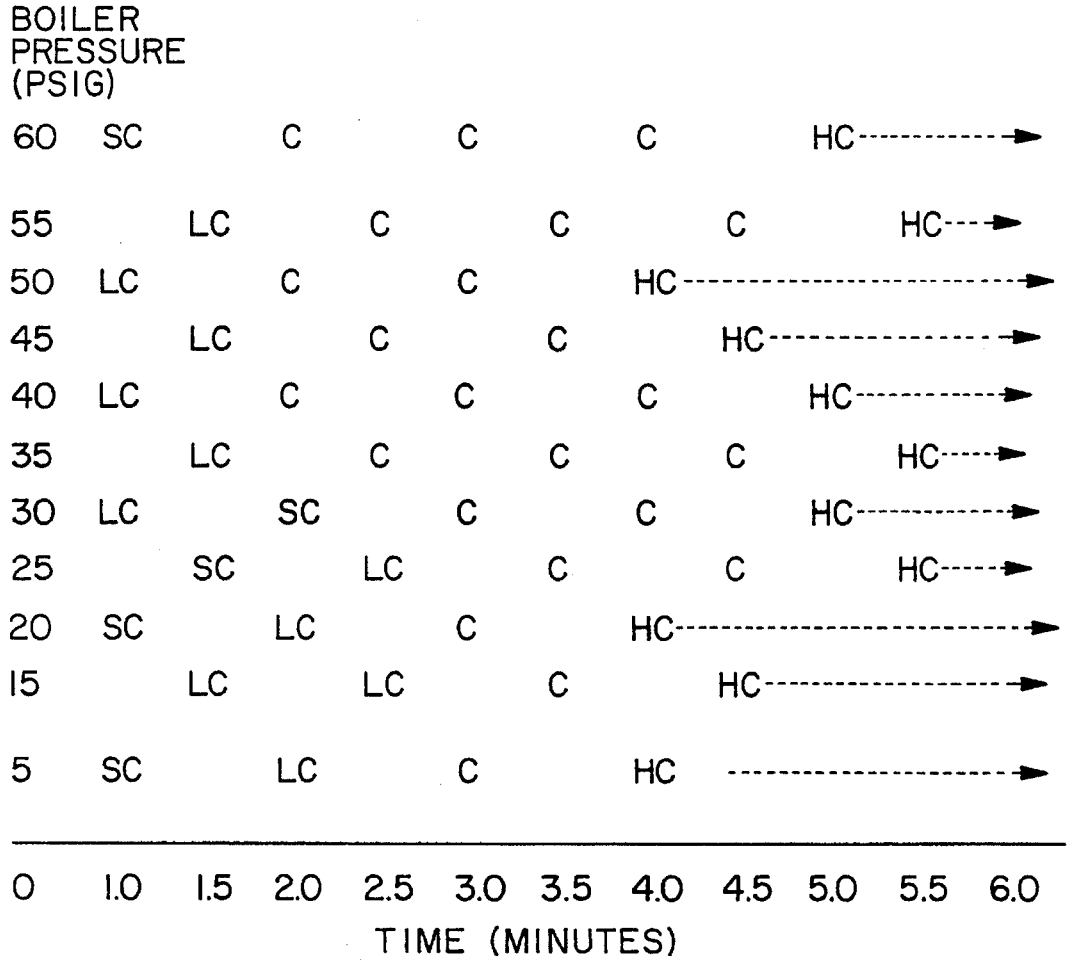
FIG. 8 illustrates a second set of test results which involved subjecting aluminum panels to pure deionized steam at elevated pressure and where the workpiece was heated prior to steam delivery.

FIGS. 5 through 8 illustrate the critical difference between "impure" steam and "pure" steam. These figures depict the results of testing which was conducted on numerous test panels. FIGS. 5 and 6 illustrate the results of test panels which were subjected to city tap (impure) water. No oxide formation developed on any of the panels. Instead, calcium carbonate and sodium chloride deposits were found. FIGS. 7 and 8 illustrate the results of test panels which were subjected to pure deionized stem. As can readily be seen by reference to FIG. 7, an oxide film was created on the aluminum surface of just about all the samples when subjected to pure deionized steam alone. FIG. 8 illustrates the results when pure steam is utilized with increased pressure (vapor header), heating the surface of the workpiece, and subjecting the article to the elevated pressure. In all the test specimens illustrated, a heavy coating, stable enough to accommodate further processing, was developed.

In a preferred embodiment, the invention can be used as an intermediate step in an multi-step conversion coating process that is chromium chromate-free. For example, the invention can be easily adapted as an adjunct to the SAFEGUARD® CC process, developed by Sanchem, Inc. and described in U.S. Pat. No. 4,711,667. In this process, the aluminum or aluminum alloy workpiece is first cleaned with an alkaline cleaner, rinsed, de-oxidized by the use of a commercially available chemical de-oxidizer, and then rinsed. The invention is then employed in order to produce the aluminum-oxide film as discussed above. After the oxide layer is generated, the workpiece is subjected to an oxide enrichment chemical bath or spray followed by a rinse with ambient temperature de-ionized water. Finally, the workpiece is subjected to a sealing chemical bath or spray followed by a second rinse. Upon drying, the surface is ready to receive an overlying coating or may be used as it is. The present invention, when properly applied, provides a tightly-sealed conversion coating that equals, and in many cases surpasses, the performance of the chromate-oxide and chromate-phosphate conversion coatings. The invention, in addition, is currently under evaluation by the military as a successor to U.S. military specification MIL-C-5541 for chemical conversion coatings on aluminum and aluminum alloys.

As discussed above, the invention has many advantages. It provides a steam conversion coating process that is a viable and non-hazardous alternative to processes that employ chromium chromate-based solutions. The invention also produces a tightly sealed conversion coating that equals, and in many cases exceeds, the work-environment performance of chromate-oxide and chromate-phosphate films. That is, the conversion coating formed has a superior adhesion quality associated with the overlying coating, and the metal obtains a protective layer that renders the metal highly resistant to both abrasion and corrosion. In addition, the invention can be easily and economically adapted to existing conversion coating systems commonly used in the field.

The aluminum-oxide film formed by the method according to the present invention is mature and bluish gray to golden brown in color. This coloring provides a visual indication that the workpiece surface has been sufficiently coated by the oxide layer.

Although the present invention has been described in considerable detail with reference to certain preferred versions thereof, other versions are possible. Therefore, the spirit and scope of the appended claims should not be limited to the description of the preferred versions contained herein.

We claim:

1. A conversion coating process for pretreating the surface of a metal selected from a group consisting of aluminum and aluminum alloys in order to increase overlying coating adhesion and diminish corrosion and abrasion, the process comprising the steps of:

delivering a flow of pure steam produced from aleionized feedwater into a chamber, the flow having an initial direction of travel;

diffusing the flow of pure steam so as to divert the flow from its initial direction of travel, the diffusion of the flow producing swirling of the pure steam;

subjecting a surface of a metal selected from a group consisting of aluminum and aluminum alloys with the swirling pure steam so as to generate an oxide layer on the metal; and subjecting the resulting oxide layer to a pressure across its face by the swirling flow of steam so as to prevent the crystallization of the oxide layer in a defined and orderly manner.

2. A conversion coating process as recited in claim 1 further comprising the steps of:

preheating the workpiece surface to a threshold temperature prior to delivering the steam;

deionizing a feedwater supply; and boiling the deionized feedwater supply to form a pure steam.

3. A conversion coating process as recited in claim 2 wherein the workpiece surface is preheated to a temperature between about 215° F. and about 250° F.

4. A conversion coating process as recited in claim 3 wherein the workpiece surface is preheated to a temperature between about 230° F. and about 250° F.

5. A conversion coating process as recited in claim 1 wherein the pure steam is delivered at a velocity of between about 0.3 CFM and about 1.3 CFM.

6. A conversion coating process as recited in claim 1 wherein the pure steam is flowed across the surface of the workpiece at a velocity less than about 5 feet per minute.

7. A conversion coating process as recited in claim 6 wherein the pure steam is flowed across the surface of the workpiece at a velocity in a range between about 1 foot per minute and about 3 feet per minute.

8. A conversion coating process for pretreating the surface of a metal selected from a group consisting of aluminum and aluminum alloys in order to increase overlying coating adhesion and diminish corrosion and abrasion, the process comprising the steps of:

deionizing a feedwater supply;

boiling the deionized feedwater supply to form a pure steam;

delivering a flow of the pure steam into a chamber, the flow having an initial direction of travel;

causing the pure steam to flow in a swirling pattern;

circulating the swirling flow of pure steam through the chamber and out an exit port so as to maintain a non-static flow environment;

subjecting a surface of a metal selected from a group consisting of aluminum and aluminum alloys with the swirling pure steam so as to generate an oxide layer; and subjecting the resulting oxide layer to a pressure across its face by the swirling flow of steam so as to prevent the crystallization of the oxide layer in a defined and orderly manner.

9. A conversion coating process according to claim 8 wherein the surface of the metal is located adjacent to the exit port and outside the chamber.

10. A conversion coating process for pretreating the surface of a metal selected from a group consisting of aluminum and aluminum alloys in order to increase overlying coating adhesion and diminish corrosion and abrasion, the process comprising the steps of:

deionizing a feedwater supply;

boiling the deionized feedwater supply to form a pure steam;

directing a flow of the pure steam into a chamber, the flow having an initial direction of travel;

directing the flow of pure steam at a baffle to divert the flow from its initial direction of travel and generate swirling flows of pure steam;

circulating the swirling flows of pure steam through the chamber and out an exit port so as to maintain a non-static flow environment;

subjecting a surface of a metal selected from a group consisting of aluminum and aluminum alloys with the swirling pure steam so as to generate an oxide layer; and subjecting the resulting oxide layer to a pressure across its face by the swirling flow of steam so as to prevent the crystallization of the oxide layer in a defined and orderly manner.

11. A conversion coating process according to claim 10 wherein the surface of the metal is positioned adjacent to the exit port and outside the chamber.

* * * * *